US005307665A

United States Patent [19]

Stuart

[11] Patent Number: 5,307,665

[45] **Date of Patent: * May 3, 1994**

[54] ELECTROMAGNETIC RE-DRAW SLEEVE ACTUATOR

[75] Inventor: Keith O. Stuart, Cypress, Calif.

[73] Assignee: Aura Systems, Inc., El Segundo, Calif.

[ * ] Notice: The portion of the term of this patent subsequent to May 25, 2010 has been disclaimed.

[21] Appl. No.: 908,453

[22] Filed: Jul. 10, 1992

Related U.S. Application Data

[63] Continuation-in-part of Ser. No. 730,634, Jul. 16, 1991.

[51] Int. Cl.[5] ..... B21D 24/10

[52] U.S. Cl. ..... 72/347; 72/430

[58] Field of Search ..... 72/347, 349, 350, 351, 72/361, 430

[56] References Cited

U.S. PATENT DOCUMENTS

| | | | |
|---|---|---|---|
| 1,606,141 | 11/1926 | Brown | 72/351 |
| 3,584,496 | 6/1971 | Keller | 72/430 |
| 4,656,400 | 4/1987 | Pailthorp | 318/135 |
| 4,808,955 | 2/1989 | Godkin | 335/222 |
| 4,912,343 | 3/1990 | Stuart | 310/14 |
| 4,934,167 | 6/1990 | Grims | 72/347 |
| 4,937,481 | 6/1990 | Vitale | 310/15 |
| 5,129,252 | 7/1992 | Hahn et al. | 72/349 |

*Primary Examiner*—Lowell A. Larson

*Attorney, Agent, or Firm*—Anthony T. Cascio; Lisa A. Clifford

[57] ABSTRACT

A linear electromagnetic actuator has its core mounted to a can body forming apparatus and its coil attached to re-draw sleeve of such apparatus. The actuator provides for the axial movement of the re-draw sleeve between its fully retracted position and its fully extended position. The re-draw sleeve and the coil are coaxially mounted to each other so that the force exerted on the re-draw sleeve is also coaxial. Once the re-draw sleeve is in its fully extended position, an electromagnet is turned on so that the re-draw sleeve exerts the requisite force on the can material preform. The electromagnet is mounted coaxially about the re-draw sleeve and exerts its force on a magnetic material ring mounted to the re-draw sleeve to hold the re-draw sleeve against the can material preform.

18 Claims, 4 Drawing Sheets

ELECTROMAGNETIC RE-DRAW SLEEVE ACTUATOR

RELATED APPLICATION DATA

The present application is a continuation-in-part of commonly owned, copending application U.S. Ser. No. 07/730,634, filed Jul. 16, 1991.

FIELD OF THE INVENTION

The present invention relates generally to improvements in can body forming apparatus and, more particularly, to improvements in actuation, control and timing of the re-draw sleeve.

BACKGROUND OF THE INVENTION

A typical beverage can is constructed from a can body and a can cover. This disclosure is directed solely to apparatus which stamps the can body.

A known prior art can body forming apparatus has four primary operable components, these being an ironing die, a re-draw sleeve, a ram and a cam/crank. The ironing die has a flat surface and a cylindrical opening therethrough disposed at the surface. The ram is reciprocatingly received through the opening. The clearance between the outer diameter of the ram and the inner diameter of the ironing die opening is commensurate with the thickness of the can body being formed. The re-draw sleeve is a cylinder in coaxial alignment with the ironing die opening and has a diameter larger than the diameter of the opening. The re-draw holds a can material preform on the ironing die surface over the opening prior to the ram forming the can body. The function of the re-draw sleeve is to hold the can material preform tightly against the die, thereby preventing material wrinkling as the ram drives the preform through the die opening. The ram is connected to the cam/crank by a connecting rod for the crank function of the cam/crank. Thus, the ram reciprocates at a frequency determined by the rotational frequency of the cam/crank. The re-draw sleeve is operable from the cam surface of the cam/crank through a push rod arrangement. Conventionally, the cam surface controls the timing of the action of the re-draw sleeve with respect to the position of the ram.

In operation, the cam/crank initially has both the ram and the re-draw sleeve in their full retracted position wherein the ram is removed from the ironing die opening and the re-draw sleeve is removed from the ironing die surface. A can material preform is dropped into place over the opening on the ironing die surface. The preform is usually cup-shaped. The rotation of the cam/crank next causes the re-draw sleeve to engage the inside of the cup-shaped preform and hold it against the ironing die surface. Continuing rotation of the cam/crank thrusts the ram into the preform. As the ram continues into the opening, the can body is formed. After one-half cycle of the crank, the ram is in its fully extended position at which it pushes the newly formed can body out the other side of the ironing die. During the second half of the cam/crank cycle, both the ram and re-draw sleeve are returned to their fully retracted position so that the next can material preform can be positioned to repeat the cycle.

One disadvantage and limitation of the above prior art apparatus is that the pushrod assembly which actuates the re-draw sleeve is off axis with respect to the re-draw sleeve. Because the force of the pushrod assembly is not co-axial with the re-draw sleeve, cam followers need to be incorporated into the apparatus to compensate for the side loads developed on the re-draw sleeve, otherwise the re-draw sleeve will not exert a uniform force along its edge against the can material preform. Accordingly, an increased number of mechanical parts are necessary to handle the side loads developed in the prior art mechanical re-draw sleeve actuator. These additional parts increase complexity and maintenance of the can forming apparatus. Furthermore, because of the intensity of the loads developed, these parts have been found to be failure prone.

These mechanical parts are mostly in the form of linkages which, because of their length and complexity, limit the speed at which the re-draw sleeve can be operated, thus limiting overall system speed. Since the force along the linkages is off axis with respect to the re-draw sleeve, the total force which can be applied thereto is accordingly limited. Excessive force will cause flexure in the linkages thereby limiting the total force the re-draw sleeve can exert on the can material preform. Also, as mentioned hereinabove, this flexure may cause the the force at the edge of the re-draw sleeve to be nonuniform.

Thus, the adaptation of the prior art apparatus to other than pure aluminum preforms is difficult. Furthermore, as the linkages wear over time, the total force that the re-draw sleeve can exert against the preform inherently decreases, thereby degrading overall operation of the can forming apparatus. For example, the total speed at which the apparatus can operate degrades, or the force along the edge of the re-draw sleeve on the can preform becomes nonuniform resulting in defective can bodies.

SUMMARY OF THE INVENTION

The above disadvantages and limitations of the prior art are addressed by a novel electromagnetic re-draw sleeve actuator in which the mechanical linkages of the prior art are eliminated. The actuator has two electromagnetic elements, one for positioning the re-draw sleeve and the other for exerting the holding force of the re-draw sleeve against the can material preform.

According to the present invention, a linear electromagnetic actuator has it core mounted to the can body forming apparatus and its coil attached to the re-draw sleeve. The actuator provides for the axial movement of the actuator between its fully retracted position and its fully extended position. In one embodiment of the invention, the re-draw sleeve and the coil are coaxially mounted to each other so that the force exerted on the re-draw sleeve is also coaxial. In another aspect of the present invention, once the re-draw sleeve is in its fully extended position, an electromagnet is turned on so that the re-draw sleeve exerts the requisite force on the can material preform. In another embodiment of the present invention, the electromagnet is mounted coaxially about the re-draw sleeve and exerts its force on a magnetic material ring mounted to the re-draw sleeve to hold the re-draw sleeve against the can material preform.

A significant advantage of the present invention over the prior art is that the use of magnetic actuation eliminates many mechanical parts, thereby enhancing overall system reliability and consistency of operation over many operating cycles. One particular feature of the invention is that the magnetic forces are developed coaxially with respect to the re-draw sleeve, eliminating the problems of the axially offset forces of the prior art. Another feature of the present invention is that the linear actuator may accelerate the re-draw sleeve in a nonlinear acceleration profile in which the re-draw sleeve is rapidly accelerated towards its extended position and decelerated immediately prior to contract with the can material preform. Yet another feature of the present invention is the ability to electromagnetically vary the holding force of the can material preform against the ironing die.

These and other objects, advantages and features of the present invention will become readily apparent to those skilled in the art from a study of the following Description of an Exemplary Preferred Embodiment when read in conjunction with the attached Drawing and appended Claims.

DESCRIPTION OF AN EXEMPLARY PREFERRED EMBODIMENT

Figure 1:
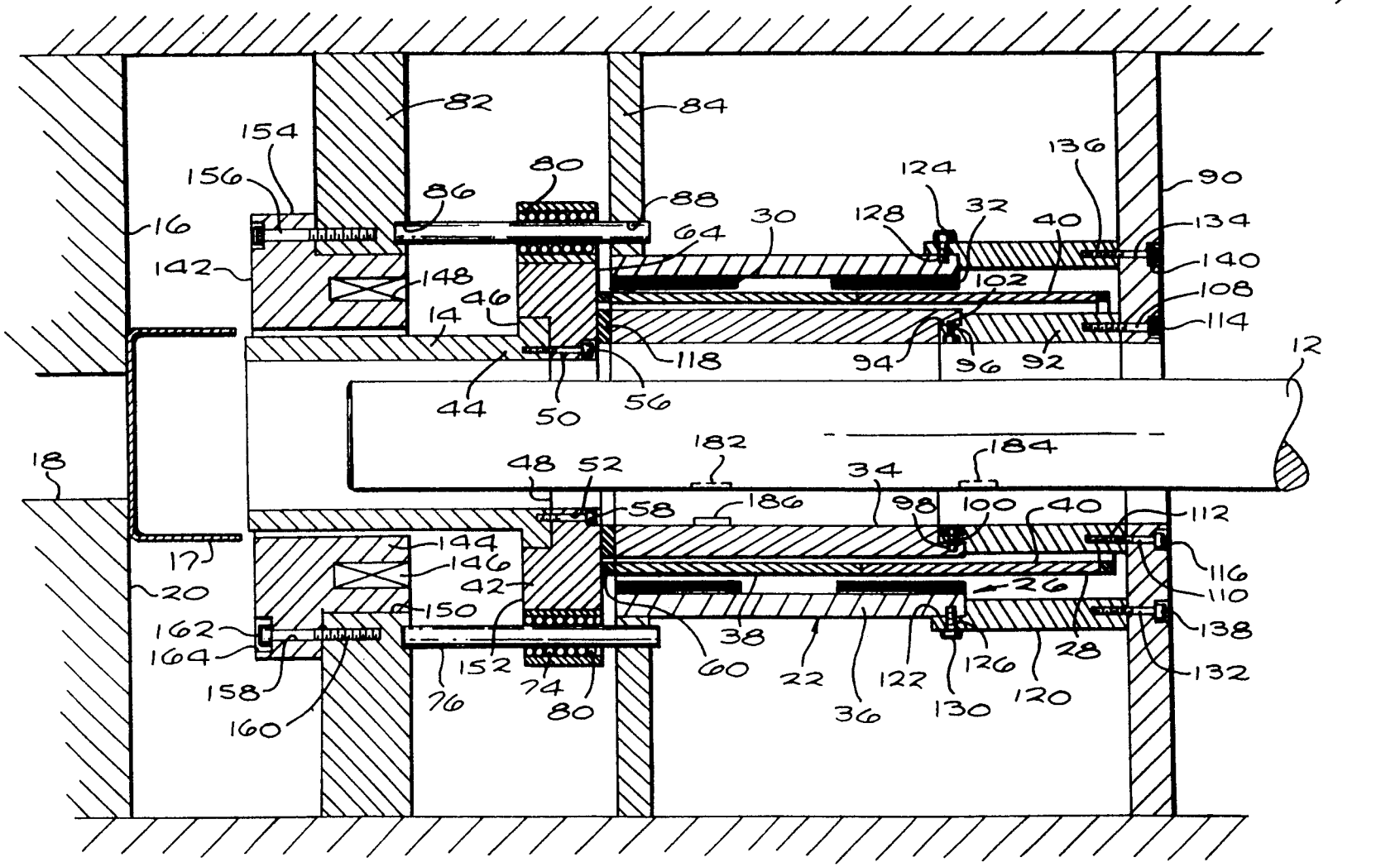
FIG. 1 is a cross sectional view of a portion of a can body forming apparatus showing the incorporation of the electromagnetic re-draw actuator with the elements positioned at the start of a stamping cycle.
Figure 2:
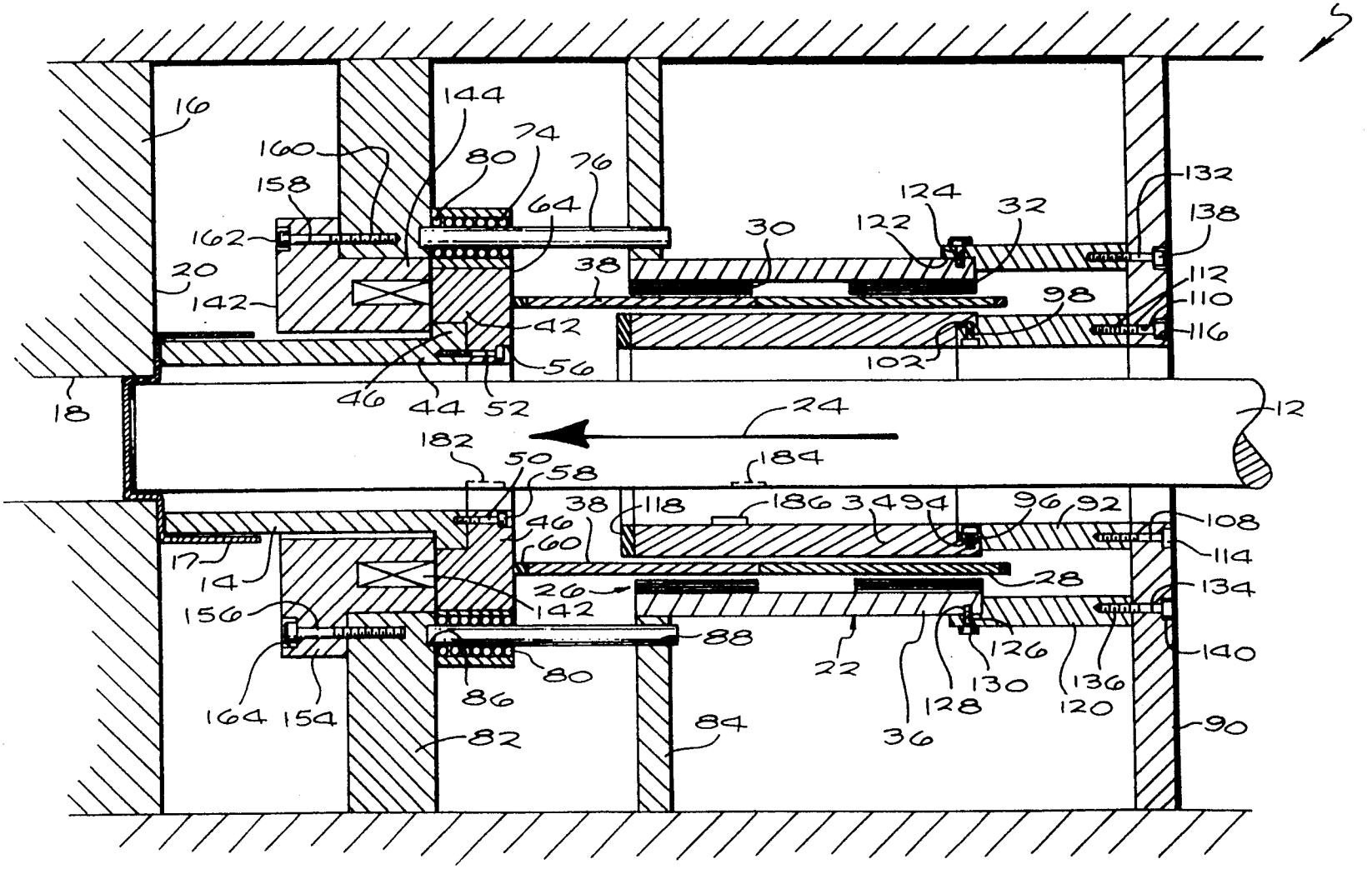
FIG. 2 is a cross sectional view of a portion of a can body forming apparatus showing the incorporation of the electromagnetic re-draw actuator with the elements positioned at a selected phase of the stamping cycle.

Referring now to FIGS. 1-2, there is shown a partial cross-sectional view of a can body forming apparatus 10. The forming apparatus includes a ram 12, a re-draw sleeve 14, and an ironing die 16. As is well known in the art, the ram 12 forms the can body by stamping a can material preform 17 through an opening 18 in the ironing die 16 while the preform is being held to a surface 20 of the ironing die 16 by the re-draw sleeve 14. The improvements to the can forming apparatus 10 relate to actuation of the re-draw sleeve 14, and, accordingly, this disclosure is limited to a description of such improvements and their incorporation into the can forming apparatus 10.

The improved can forming apparatus 10 includes a linear electromagnetic actuator 22 to actuate the re-draw sleeve 14 between its fully retracted position, as best seen in FIG. 1 at the initiation of stamping cycle, and its fully extended position, as best seen in FIG. 2 during the first half cycle of a stamping cycle with the ram 12 moving in the direction shown at 24. The actuator 22 includes a core 26 and a coil 28.

The core 26 includes a first radially polarized magnet 30, a second radially polarized magnet 32, a cylindrical inner core member 34 and a cylindrical outer core member 36. The first magnet 30 is of reverse polarity with respect to the second magnet 32. The inner core member 34 and the outer core member 36 are constructed from magnetic flux conductive material. Accordingly, the closed loop flux path is radial at the first magnet 30 and second magnet 32 and axial along the inner core member 34 and the outer core member 36 between the first magnet 30 and the second magnet 32.

The coil 28 has a first coil half 38 proximately disposed to the first magnet 30 and a second coil half 40 electrically serially connected to the first coil half 38 and proximately disposed to the second magnet 32. However, the second coil half 40 is wound counter to the first coil half 38 such that a current through the entire length of the coil 28 is of a first polarity in the first coil half 38 and of a second, opposite polarity in the second coil half 40. Therefore, the current through the coil 28 will be of proper polarity in the first coil half 38 and the second coil half 40 when intersecting the radial flux at the respective one of the first magnet 30 and the second magnet 32 such that the contributions to force at each of the first coil half 38 and the second coil half 40, as defined by the cross product of the current and flux, are additive.

The above described actuator 22, with the reverse polarity coil halves 38,40 allows for a brushless design with the current taps of the coil 28 being at each end thereof. However, the actuator 22 may also be of the design as disclosed in U.S. Pat. No. 4,912,343, which has been assigned to the assignee of record and which is incorporated herein by reference.

In a preferred embodiment of the present invention, the coil 28 is coaxially mounted to the re-draw sleeve 14 such that all force exerted on the re-draw sleeve 14 during extension and retraction is coaxial thereto. To mount the coil 28 to the re-draw sleeve 14, a ring 42 is provided. The ring 42 is preferably mounted to a first end 44 of the re-draw sleeve 14, although any axial position along the re-draw sleeve 14 is possible, as will become readily apparent from a description hereinbelow of another feature of the present invention. More particularly, the first end 44 of the re-draw sleeve 14 has an annular flange 46. The ring 42 has a counterbore 48 dimensioned to receive the flange 46. A plurality of threaded fasteners 50 are received through respective ones of radially disposed axial openings 52 to engage corresponding ones of threaded bores 54 in the flange 46. Each opening 52 has a counterbore 56 in which a head 58 of the fastener 50 engages the flange 46. A distal end 60 of the first coil half 38 is attached directly to a surface 64 of the ring 42.

Supporting the assembled structure of the coil 28 and the re-draw sleeve 14 in linear slideable engagement to the apparatus 10 are linear bearings 74 on bearing support shafts 76. The support shafts 76 are radially disposed in parallel to the axis of the coil 28/re-draw sleeve 14 assembly. Each of the linear bearings 74 are received by a respective one of the support shafts 76. The linear bearings 74 are attached to an outer peripheral surface 78 of the ring 42. An O-ring 80 is preferably provided at each end of the bearings 74 to keep dirt and debris out. Each of the bearings 74 may also include a grease fitting (not shown). The support shafts 76 are preferably disposed in equal angular increments about the axis of the coil 28/re-draw sleeve 14 assembly. For example, four such shafts 76 may be used.

To mount the support shafts 76 to the apparatus 10, a first annular mounting member 82 and a second annular mounting member 84 are affixed to the apparatus 10. The first mounting member 82 has a plurality of partially sunk bores 86 and the second mounting member 84 has a plurality of corresponding throughbores 88. Each of the support shafts 76 are received through a respective one of the throughbores 88 with their tips held by the corresponding partially sunk bore 86. The shafts 76 may be press fit into the bores 86,88.

Completing the description of the actuator 22, the core 26 is carried by the second mounting member 84 and attached to a third annular mounting member 90. More particularly, the inner core member 34 of the core 26 is attached to the third mounting member 90 through a first cylindrical attachment member 92. One end of the inner core member 34 has a counterbore 94 and one end of the first attachment member 92 has a corresponding annular lip 96 dimensioned to be received within the counterbore 94. A plurality of threaded fasteners 98 are received through a respective one of radial bores 100 in the lip 96 and are engaged to a corresponding one of threaded bores 102 radially disposed within the counterbore 94. A head 104 of the fasteners 98 then engage the first attachment member 92 within a counterbore 106. The other end of the first attachment member 92 is mounted to the third mounting member 90 by a plurality of threaded fasteners 108 received through a respective one of a plurality of radially disposed axial bores 110 in the third mounting member 90 and engage a corresponding one of threaded bores 112 in the first attachment member 92. A head 114 of the fasteners 108 then engages the third mounting member 90 in a respective one of counterbores 116. The other end of the cylindrical inner core member 34 carries an annular elastomeric ring 118. The ring 118 absorbs shock when the coil 28 returns to its first position, i.e., the re-draw sleeve returning to the fully retracted position, by cushioning the contact with the surface 64 of the ring 42.

Similarly, the outer core member 36 of the core 26 is secured to the third mounting member by a second cylindrical attachment member 120. More particularly, one end of the second attachment member 120 has a counterbore 122 dimensioned to receive one end of the outer core member 36. A plurality of threaded fasteners 124 are received through respective ones of a plurality of radial bores 126 in the second attachment member 120 communicating with the counterbore 122. The fasteners 124 engage corresponding ones of threaded radial bores 128 in the outer core member 36. A head 130 of each of the fasteners thus engages the outer surface of the second attachment member 120. The other end of the second attachment member 120 is mounted to the third mounting member 90 by a plurality of threaded fasteners 132 received through a respective one of a plurality of radially disposed axial bores 134 in the third mounting member 90 and engage a corresponding one of threaded bores 136 in the second attachment member 120. A head 138 of the fasteners 132 then engages the third mounting member 90 in a respective one of counterbores 140.

The first magnet 30 is carried by the inner surface of the outer core member 36 in a spaced relationship to the first coil half 38. Similarly, the second magnet 32 is carried by the inner surface of the outer core member 36 in a spaced relationship to the second coil half 40. The axial length of the first magnet 30, the second magnet 32, the first coil half 38 and the second coil half 40 are related such that, as the coil 28 moves between its first position of FIG. 1 and the second position of FIG. 2, the first coil half 38 is always within the flux path of the first magnet 30 and the second coil half 40 is always within the flux path of the second magnet 32. The length thereof is also determined by the total magnetic flux and coil current needed.

For example, the flux will be determined by the total force required by the actuator 22 and the current capability of the coil 28. It is well known that the total force, F, that the actuator can develop is equal to the cross product of the magnetic flux, B, with the product of the coil length, L, and the total coil current I, or $F=IL\times B$. The required force, F, required by the actuator 22 to move the re-draw sleeve 14 between its fully retracted position and fully extended position is dependent on the maximum speed of the apparatus 10, or its cycle time, the distance between the fully extended and the fully retracted positions, X, and the mass, m, of the moving assembly of the re-draw sleeve 14, the ring 42 and the coil 28. The force can thus be computed from the well known relationships of $F=mA$ and $A=2X/T_2$, where T is the time required to move between the fully retracted to the fully extended position.

The above analysis of the force, F, is true if a constant force is to be developed by the actuator 22. However, in some instances, it is desirable to vary the force profile by varying the current amplitude profile of the current in the coil 28. For example, it may be desirable to apply a force profile to the re-draw sleeve 14 so that the re-draw sleeve 14 makes contact with the can material preform 17 with zero velocity to prevent the re-draw sleeve 14 from slamming into the preform 17. Since the actuator 22 is a linear device, the force profile will be determined by the amplitude profile of the current in the coil 28.

In one embodiment, the can body forming apparatus 10 operates at a set frequency, or cycle time. A sinusoidal current applied to the coil 28, when having a frequency, f, commensurate with the frequency of operation of the apparatus 10, will cause the actuator 22 to move the re-draw sleeve 14 sinusoidally over its travel distance, X, with the acceleration, A, of the coil 28 and hence the force, F, the actuator 22 applies to the re-draw sleeve 14 being maximum amplitude at its fully retracted and fully extended positions, with the corresponding velocity at these positions being zero, thereby preventing slamming of the re-draw sleeve 14 at either of its extreme positions.

More particularly, a sinusoidal force may be given by the expression $F=F_{max}\cos wt$, where $w=2pf$. From above, $F_{max}=mA_{max}$. Twice integrating, the expression $X=(-mA_{max}/w^2)\cos wt$ is obtained. By observation it is seen that the maximum stroke, $X_{max}$, of the coil 28 or re-draw sleeve 14 is $X_{max}=mA_{max}/w^2$, or $A_{max}=Xw^2/m$. Therefore, it is seen that $F_{max}=Xw^2$.

In another aspect of the present invention the apparatus 10 includes an electromagnet 142 mounted to the first mounting member 82 in a coaxial relationship to the re-draw sleeve 14. More particularly, the electromagnet 142 has a core 144 and a coil 146 disposed in an annular channel 148 in the face 150 of the core 144. The face 150 is in a facing relationship to a second surface 152 of the ring 42. The positioning of the electromagnet 142 and the ring 42 is determined so that the face 150 and surface 152 are adjacent each other with a predetermined gap remaining therebetween when the re-draw sleeve 14 is in its fully extended position.

To mount the electromagnetic 142, the core has an annular flange 154 which abuts the first mounting member 82. A plurality of threaded fasteners 156 are received through a respective one of a plurality of radially disposed axial bores 158 in the first mounting member 82 and engage a corresponding one of threaded bores 160 in the first mounting member 82. A head 162 of the fasteners 156 then engages the first mounting member 82 in a respective one of counterbores 164.

The ring 42 and electromagnet 142 are provided to hold the re-draw sleeve 14 in its fully extended position with the requisite force acting on the can material preform 17 to hold it against the ironing die 16. As will be described in greater detail hereinbelow, the electromagnet 142 is turned on by applying a current to the coil 146 upon the actuator 22 bringing the re-draw sleeve 14 to its fully extended position and turned off when the ram 12 pushes the just formed can body out of the opening 18 in the ironing die 16 so that the actuator 22 can return the re-draw sleeve 14 to its retracted position to initiate the next stamping cycle. The magnetic force acting on the ring 42 when the electromagnet is turned on is determined by the size of the electromagnet, the gap between its face 150 and the surface 152 of the ring 42, the area of the surface 152, and the volume of the ring 42. As a feature of the present invention, the electromagnet 142 and the ring 42 are coaxially disposed about the re-draw sleeve 14 so that the force that the re-draw sleeve 14 exerts on the can material preform 17 will be uniformly distributed. Another feature of the present invention is that the current in the coil 146 of the electromagnet 142 may be predetermined so that the holding force of the re-draw sleeve 14 against the can material preform 17 may be predetermined and varied depending on the material used.

Figure 3:
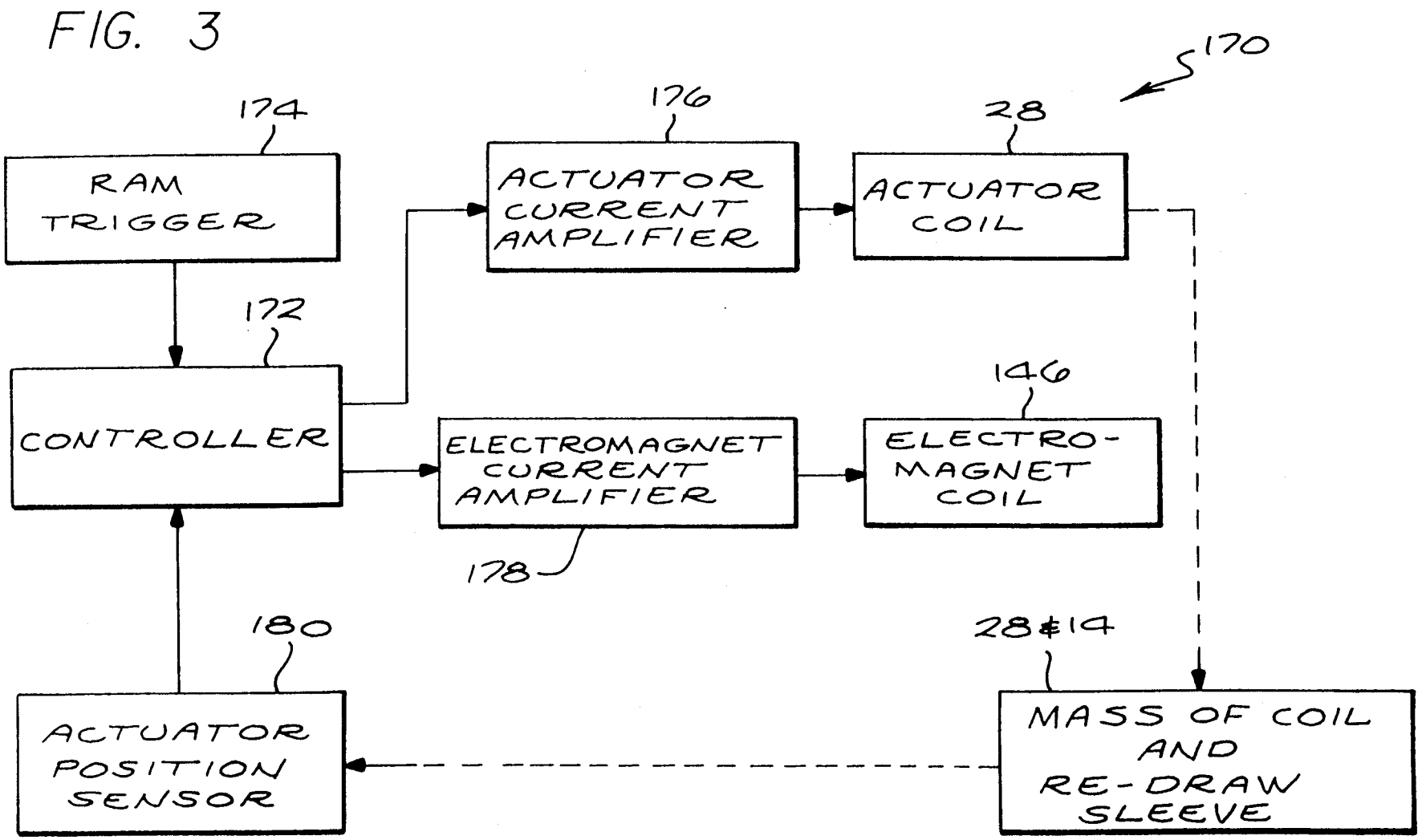
FIG. 3 is a schematic block diagram of a timing and control circuit used to control the novel re-draw sleeve actuator of FIG. 1.

With further reference to FIG. 3, the control and timing of the actuator 22 and the electromagnet 142 are described in greater detail. At the beginning of a can body forming cycle, the ram 12 is in its fully retracted position and the can material preform 17 has been fed into position onto the surface 20 of the ironing die over the opening 18 thereof. A timing and control circuit 170 activates the actuator 22 when the ram 12 is fully retracted to move the coil 28 from its first position of FIG. 1 to its second position of FIG. 2, therefore, moving the re-draw sleeve 14 from its fully retracted position to its fully extended position, respectively, wherein it engages the cam material preform 17. Furthermore, the timing and control circuit 170 also activates the electromagnet 142 by applying a current to the coil 146 when the coil 28 has been brought to the second position.

During the first half cycle, the ram 12 moves in the direction of the arrow 24 forming a can body in the clearance between the ram 12 and the opening 18 of the ironing die 16. At the conclusion of the first half cycle, the ram 12 is in its fully extended position and the just formed can body exits from the backside (not shown) of the ironing die 16. When the ram 12 is in its fully extended position, the timing and control circuit 170 turns off the electromagnet 142 by removing the current from the coil 146 and activates the actuator 22 to return the coil 28 to its first position, and hence the re-draw sleeve 14 to its fully retracted position.

During the second half cycle, the ram 12 returns to its full retracted position. Once the ram 12 has cleared the opening 18 of the ironing die 16, the next can material preform may be brought into position. When the timing and control circuit 170 determines that the ram 12 is fully retracted, the next successive cycle begins.

To determine the position of the ram 12 and to activate the actuator 22 and electromagnet 142, the timing and control circuit 170 includes a controller 172, a ram trigger 174, an actuator current amplifier 176, an electromagnet current amplifier 178 and an actuator position sensor 180. The controller 172 determines from the ram trigger 174 when the ram 12 is fully, or near fully, retracted and when the ram 12 is fully extended, or alternatively when the ram 12 has pushed a can body from the back of the ironing die 16 even though the ram 12 is not yet fully extended. In response to the position of the ram 12, the controller develops a current amplitude profile for application to the actuator current amplifier 176. The actuator current amplifier 176 develops the current for the coil 28 with the desired amplitude profile, such that the predetermined force profile, for both extension and retraction, acts on the coil/re-draw sleeve mass as seen in FIG. 3.

The controller 172 also determines from the actuator position sensor 180 the position of the coil 28, and in particular when the coil 28 is in its second position, and hence the re-draw sleeve 14 in its fully extended position. In response thereto, the controller 172 develops the predetermined current amplitude profile for application to the electromagnet current amplifier 178. The electromagnet current amplifier then develops the current for application to the coil 146 of the electromagnet 142 with the predetermined amplitude commensurate with the desired holding force. The actuator position sensor 180 may, in one embodiment of the present invention, be a linear voltage differential transformer (LVDT) as is known in the art. The controller 172 may be either digital or analog.

The ram trigger 174 may include a first permanent magnet 182, a second permanent magnet 184 and a Hall effect sensor 186. The first and second permanent magnets 182,184 are mounted at selected axial positions along the ram 12, and the sensor 186 is mounted to the inner core member 34 facing the ram 12 as best seen in FIGS. 1-2. The sensor 186 and the permanent magnets 182,184 are positioned so that the first permanent magnet 182 is aligned with the sensor 186 when the ram 12 is fully retracted and the second permanent magnet 184 is aligned with the sensor 186 when the ram 12 is fully extended. The permanent magnets 182,184 are biased so that each magnet 182,184 presents an opposite pole to the sensor 186. Therefore, when the first permanent magnet 182 aligns with the sensor 186, the sensor 186 develops a first electrical signal. Similarly, when the second permanent magnet 184 aligns with the sensor 186, the sensor 180 develops a second electrical signal of opposite polarity to the first signal. In response to the first and second electrical signals.

Alternatively, the ram trigger 174 may also sense the position of the cam/crank (not shown) which activates the ram as described above. In some particular types of can body forming apparatus 10, the cam/crank include position markers attached to cam/crank that activates the ram 12, and a sensor to detect these markers. Since the angular position of the cam/crank determines the axial position of the ram 12, such a sensor would apply a signal to the controller 172 as described hereinabove. The controller may also detect, as is also known, the can material preform being dropped into place on the ironing die 16 to activate the actuator 22.

Figure 4:
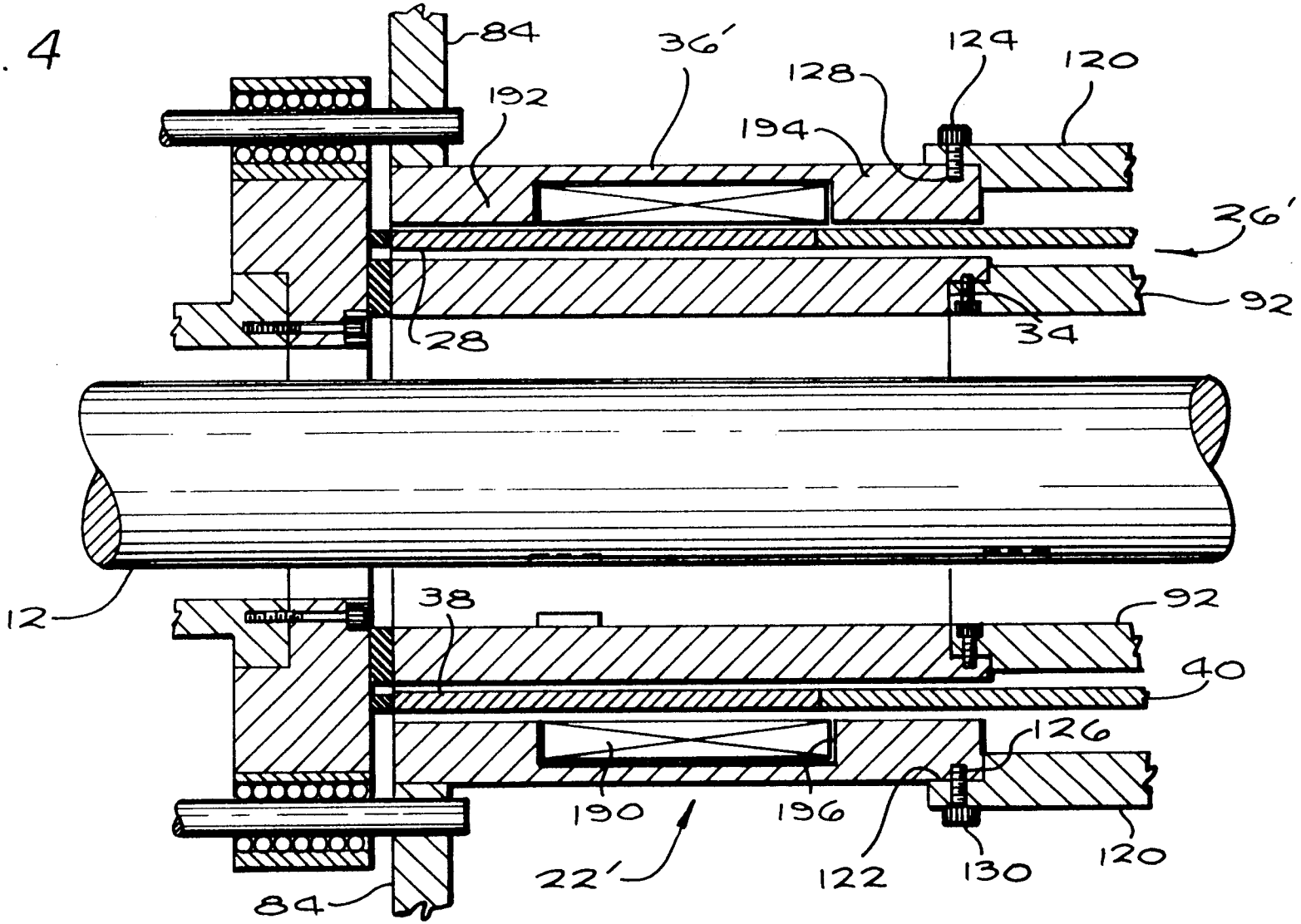
FIG. 4 is an alternative embodiment of an actuator as shown in FIGS. 1-2.

Referring now to FIG. 4, there is shown an electromagnetic actuator 22' which as an alternative embodiment of the actuator 22 shown in FIGS. 1-2 above. The actuator 22' includes a core 26' and the coil above described 28. The core 26' differs from the core 26 in that the core 26' does not require the permanent first and second magnets 30,32 as above described.

More particularly, the core 26' includes the inner core member 34 as described hereinabove, a cylindrical outer core member 36' and a field coil 190. As will be described in greater detail herein below, the field coil 190 replaces the first and second magnets 30, 32 to develop the same closed loop flux path within the actuator 22.

The outer core member 36' has a first end region 192 and a second end region 194. The first end region 192 and the second end region 194 each extend radially inwardly from the outer core member 36'. The first end region 192 and the second end region 194 define an annular channel 196 within the outer core member 36'.

The field coil 190 is disposed within the annular channel 196. The field coil is wound such that a constant DC current developed therein will develop an axial flux through the inner core member 34, the outer core member 36' and a radially directed flux in a first direction between the inner core member 34 and the first end region 192 and a radially directed flux in the opposite direction between the inner core member 34 and the second end region 194.

The coil 28 has its first coil half 38 proximately disposed to the first end region 192 and its second coil half 40 electrically serially connected to the first coil half 38 and proximately disposed the second end region 194. As described hereinabove, the second coil half 40 is wound counter to the first coil half 38 such that a current throughout the entire length of the coil 28 is of a first polarity in the first coil half 38 and of a second, opposite polarity in the second coil half 40. Therefore, the current through the coil 28 will be of proper polarity in the first coil half 38 and the second coil half 40 when intersecting the radial flux at the respective one of the first end region 192 and the second end region 198. Accordingly, the contributions to force at each of the first coil half 38 and the second coil half 40, as defined by the vector cross product of the current and flux, are additive.

There has been described hereinabove a novel re-draw sleeve actuator for can body forming apparatus. Those skilled in the art may now make numerous uses of and departures from the hereinabove described embodiments without departing from the inventive concepts disclosed herein. Accordingly, the present invention is to be defined solely by the scope of the following claims.

I claim:

1. In a can forming apparatus in which a cylindrical re-draw sleeve holds a can material preform against an ironing die while a ram pushes said preform through an opening in said die to form a can body, an improvement comprising:

a linear electromagnetic actuator having an actuator core mounted to said apparatus and a coil element moveable between a first position and a second position, said actuator core having an inner core member, an outer core member and a field coil, said field coil being intermediate said inner core member and said outer core member, said outer core member having a first end region and a second end region, said first end region and said second end region each extending inwardly toward said coil element, said field coil being disposed intermediate said first end region and said second end region, said field coil developing magnetic flux in said core in response to an electrical current therein said re-draw sleeve being mounted to said coil element and further being in a retracted position to allow placement of said can material preform against said ironing die when said coil element is in said first position and in an extended position to hold said can material preform against said ironing die when said coil element is in said second position; and a timing and control circuit to activate said actuator to place said coil element in said second position when said ram is in a retracted position and to return said coil element to said first position when said ram is in an extended position.

2. An improvement as set forth in claim 1 wherein said coil is coaxially mounted to said re-draw sleeve.

3. An improvement as set forth in claim 1 wherein said control circuit includes:

a ram trigger to develop a first electrical signal when said ram is in said retracted position and a second electrical signal when said ram is in said extended position; and a controller to develop a first current amplitude profile for a current to be applied to said coil in response to said first signal and a second current amplitude profile for a current to be applied to said coil in response to said second signal.

4. An improvement as set forth in claim 3 wherein said ram trigger includes:

a first magnet mounted at a first axial position on said ram so that a first magnetic pole is radially disposed at said first position;

a second magnet mounted at a second axial position on said ram so that a second magnetic pole opposite said first pole is radially disposed at said second position; and a sensor mounted to said apparatus proximate said ram to develop said said first signal when said sensor detects said first pole and to develop said second signal when said sensor detects said second pole.

5. An improvement as set forth in claim 4 wherein said sensor is a Hall effect sensor.

6. An improvement as set forth in claim 3 wherein said first signal is an analog electrical signal of a first polarity and said second signal is an analog electrical signal of a second polarity opposite said first polarity.

7. An improvement as set forth in claim 3 wherein said control circuit further includes:

a current amplifier to develop said current in response to said first current amplitude profile and said second current amplitude profile.

8. An improvement as set forth in claim 7 wherein said first current has an amplitude selected to accelerate said coil to substantially said second position and decelerate said coil upon imminently approaching said second position such that said re-draw sleeve is prevented from slamming into said can material preform.

9. In a can forming apparatus in which a cylindrical re-draw sleeve holds a can material preform against an ironing die while a ram pushes said cup through an opening in said die to form a can body, an improvement comprising:

a linear electromagnetic actuator having an actuator core mounted to said apparatus and a coil element moveable between a first position and a second position, said actuator core having an inner core member, an outer core member and a field coil, said field coil being intermediate said inner core member and said outer core member, said outer core member having a first end region and a second end region, said first end region and said second end region each extending inwardly toward said coil element, said field coil being disposed intermediate said first end region and said second end region, said field coil developing magnetic flux in said core in response to an electrical current therein said re-draw sleeve being mounted to said coil element and further being in a retracted position to allow placement of said can material preform against said ironing die when said coil element is in said first position and in an extended position to hold said can material preform against said ironing die when said coil element is in said second position;

an electromagnet mounted to said apparatus;

a ring of magnetic material mounted coaxially to said re-draw sleeve so that said ring is adjacent said electromagnet when said re-draw sleeve is in said extended position; and a timing and control circuit to activate said actuator to place said coil element in said second position when said ram is in a retracted position and to return said coil element to said first position when said ram is in an extended position, and further to activate said electromagnet when said re-draw sleeve has been brought to said extended position so that magnetic force on said ring holds said re-draw sleeve against said can material preform and to deactivate said electromagnet when said re-draw sleeve is to return to said retracted position.

10. An improvement as set forth in claim 9 wherein said coil is coaxially mounted to said re-draw sleeve.

11. An improvement as set forth in claim 9 wherein said control circuit includes:

a ram trigger to develop a first electrical signal when said ram is in said retracted position and a second electrical signal when said ram is in said extended position;

a controller to develop a first current amplitude profile for a current to be applied to said coil in response to said first signal and a second current amplitude profile for a current to be applied to said coil in response to said second signal.

12. An improvement as set forth in claim 11 wherein said ram trigger includes:

a first magnet mounted at a first axial position on said ram so that a first magnetic pole is radially disposed at said first position;

a second magnet mounted at a second axial position on said ram so that a second magnetic pole opposite said first pole is radially disposed at said second position;

a sensor mounted to said apparatus proximate said ram to develop said said first signal when said sensor detects said first pole and to develop said second signal when said sensor detects said second pole.

13. An improvement as set forth in claim 12 wherein said sensor is a Hall effect sensor.

14. An improvement as set forth in claim 11 wherein said first signal is an analog electrical signal of a first polarity and said second signal is an analog electrical signal of a second polarity opposite said first polarity.

15. An improvement as set forth in claim 11 wherein said control circuit further includes:

a current amplifier to develop said current in response to said first current amplitude profile and said second current amplitude profile.

16. An improvement as set forth in claim 15 wherein said first current has an amplitude selected to accelerate said coil to substantially said second position and decelerate said coil upon imminently approaching said second position such that said re-draw sleeve is prevented from slamming into said can material preform.

17. An improvement asset forth in claim 11 wherein said controller activates said electromagnet in response to expiration of said first current profile and deactivates said electromagnet in response to initiation of said second current profile.

18. An improvement as set forth in claim 9 wherein said magnetic force is variable as a function of a current amplitude applied to said electromagnet.

* * * * *